US010196118B2

(12) United States Patent
Strak

(10) Patent No.: US 10,196,118 B2
(45) Date of Patent: Feb. 5, 2019

(54) PROPELLABLE AQUATIC BOARD

(71) Applicant: Wayne H. Strak, Elk River, MN (US)

(72) Inventor: Wayne H. Strak, Elk River, MN (US)

( * ) Notice: Subject to any disclaimer, the term of this patent is extended or adjusted under 35 U.S.C. 154(b) by 0 days.

(21) Appl. No.: 15/211,879

(22) Filed: Jul. 15, 2016

(65) Prior Publication Data

US 2017/0015396 A1 Jan. 19, 2017

Related U.S. Application Data

(60) Provisional application No. 62/193,981, filed on Jul. 17, 2015.

(51) Int. Cl.

| | |
|---|---|
| ***B63H 1/32*** | (2006.01) |
| ***B63H 16/08*** | (2006.01) |
| ***B63B 35/79*** | (2006.01) |

(52) U.S. Cl.

CPC ..... *B63H 1/32* (2013.01); *B63B 35/79* (2013.01); *B63H 16/08* (2013.01)

(58) Field of Classification Search

CPC ... B63H 1/32; B63H 1/36; B63H 1/37; B63H 16/00; B63H 16/08; B63B 35/79

USPC ..... 440/13–15, 21, 22

See application file for complete search history.

(56) References Cited

U.S. PATENT DOCUMENTS

| | | | | | |
|---|---|---|---|---|---|
| 3,256,850 | A * | 6/1966 | Bramson | B63H 16/08 | 416/82 |
| 3,317,937 | A * | 5/1967 | Gallagher | B63B 35/7906 | 441/74 |
| 3,714,921 | A * | 2/1973 | Gibson | B63B 7/08 | 441/129 |
| 3,779,202 | A * | 12/1973 | Martin | B63H 16/20 | 114/283 |
| 3,874,319 | A * | 4/1975 | Martin | B63H 16/20 | 440/27 |
| 4,649,847 | A * | 3/1987 | Tinkler | B63B 35/7926 | 114/284 |
| 4,968,273 | A * | 11/1990 | Momot | B63H 1/36 | 440/14 |
| 9,248,344 | B2 * | 2/2016 | Radwan | B63H 1/36 | |
| 2016/0107731 | A1 * | 4/2016 | Chen | B63B 35/7926 | 441/66 |

FOREIGN PATENT DOCUMENTS

| | | | | |
|---|---|---|---|---|
| DE | 2557306 A1 * | 6/1977 | | B63H 1/36 |
| DE | 3404473 A * | 8/1985 | | B63H 1/36 |
| FR | 2574748 A3 * | 6/1986 | | B63H 1/36 |

* cited by examiner

*Primary Examiner* — Ajay Vasudeva
(74) *Attorney, Agent, or Firm* — Merchant & Gould P.C.

(57) ABSTRACT

A propellable aquatic board includes a main body that is at least partially buoyant. The propellable aquatic board also includes a flexible member secured to the main body by a fastener. The flexible member extends away from the main body in a longitudinal direction. The flexible member is configured to selectively deflect to propel the aquatic board through water.

13 Claims, 8 Drawing Sheets

PROPELLABLE AQUATIC BOARD

CROSS REFERENCE TO RELATED APPLICATION

This application claims the benefit of U.S. Provisional Application No. 62/193,981, filed Jul. 17, 2015, the disclosure of which is hereby incorporated herein by reference.

BACKGROUND

Human powered watercrafts are popularly used for recreation and exercise in large bodies of water such as lakes, rivers and oceans. Examples of such watercraft include surfboards, stand-up paddle boards, kayaks, canoes, etc. However, many human-powered watercrafts are propelled by a human using only a single group of muscles such as by operating a paddle, oar, or pedals. Therefore improvements in human-powered watercrafts are needed.

SUMMARY

The present disclosure relates generally to a propellable aquatic board. In one possible configuration, and by non-limiting example, the aquatic board includes a flexible member extending away from the rear of the main body of the board.

In one aspect of the present disclosure, a propellable aquatic board is disclosed. The propellable aquatic board includes a main body that is at least partially buoyant. The propellable aquatic board also includes a flexible member secured to the main body by a fastener. The flexible member extends away from the main body in a longitudinal direction. The flexible member is configured to selectively deflect to propel the aquatic board through water.

In another aspect of the present disclosure, a propellable aquatic board is disclosed. The propellable aquatic board includes a main body that is at least partially buoyant. The main body includes a top surface, a bottom surface, a front portion, and a rear portion. The bottom surface is configured to be at least partially submerged in a body of water. The top surface is generally a solid flat surface and the bottom surface is generally a rounded surface. The propellable aquatic board includes a pocket recessed in the rear portion of the bottom surface of the main body. The propellable aquatic board also includes a plurality of flexible members secured within the pocket by a fastener. The flexible members extend away from the main body in a longitudinal direction opposite the front portion of the main body. The flexible members are configured to selectively deflect to propel the aquatic board through water.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
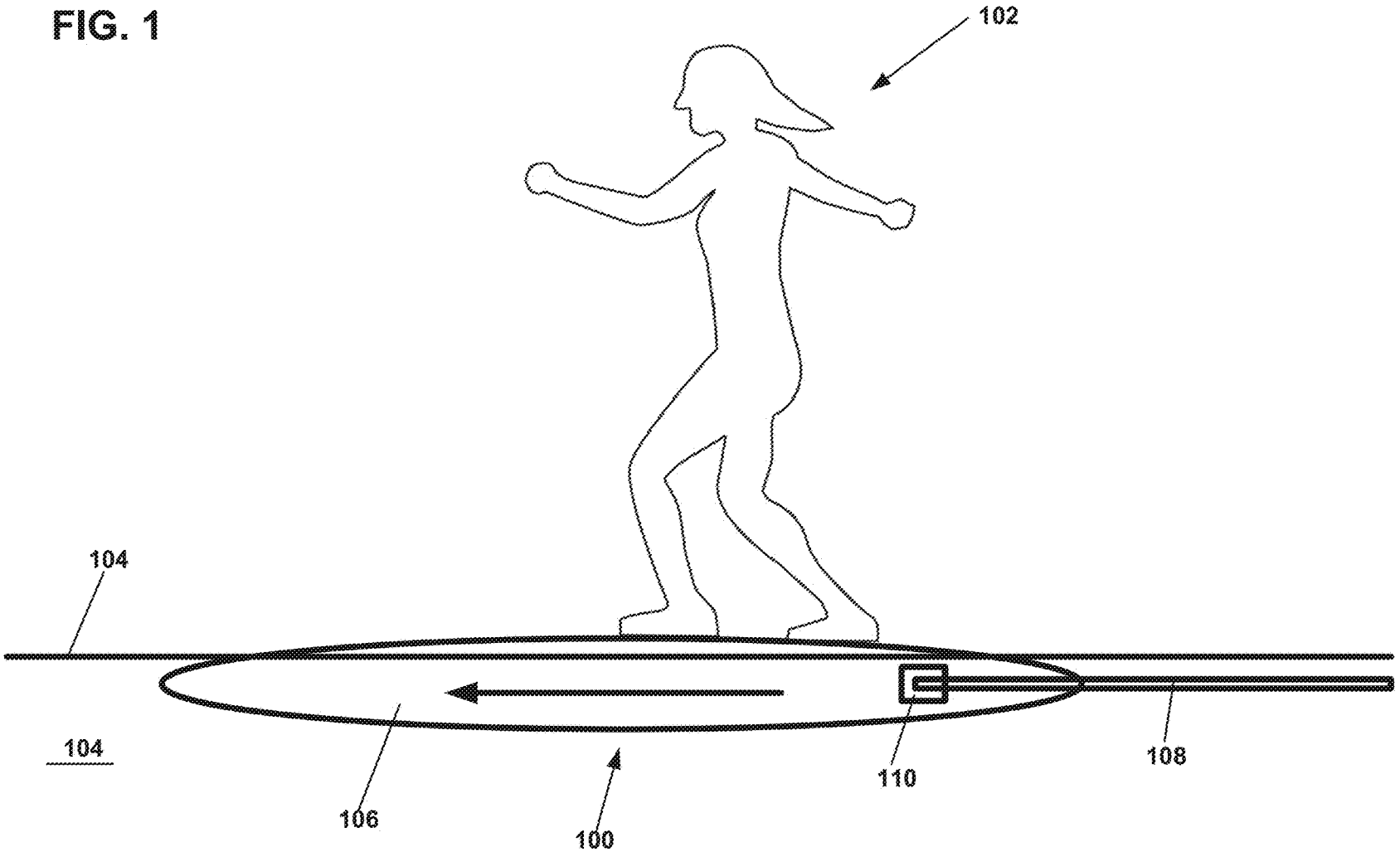
FIG. 1 illustrates a schematic view of a propellable aquatic board, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The propellable aquatic board disclosed herein has several advantages. The board has at least one flexible member that extends from a main body of the board. The flexible member can be used to propel the board through the water. This is done by the rider shifting their weight on the board while the board is in the water. Such movement offers an engaging experience while also offering the user a form of exercise. Therefore, the board can be propelled through the water by use of human power without the use of an external device, such as an oar, motor, etc.

A propellable aquatic board 100 is shown in FIG. 1. The board 100 is shown with a rider 102 positioned atop the board 100 in a body of water 104. The board 100 includes a main body 106 and a flexible member 108. As discussed in more detail herein (with respect to FIG. 8), by shifting his/her weight on the board 100, the rider 102 can propel the board 100 through the water 104 in a forward direction (shown in FIG. 1 by an arrow).

The main body 106 is at least partially buoyant so as to at least partially float in the water 104. The main body 106 can be constructed from a variety of different materials such as Polyurethane (PU), Polystyrene (PS), Expanded Polystyrene (EPS) foam, fiberglass, wood, or other similar material.

The flexible member 108 is secured to the main body 106 by a fastener 110. The flexible member 108 extends away from the main body 106 in a longitudinal direction. The flexible member 108 is configured to selectively deflect to propel the board 100 in water. In some embodiments, a plurality of flexible members 108 can be utilized with the board 100. The flexible member 108 can also be readily removable from the main body 106 so as to allow for improved portability of the board as well as to ease replacement of the flexible member 108 should it get damaged.

In some embodiments, the flexible member is 108 is manufactured from fiberglass or other similar resilient flexible material. In some embodiments, the flexible member 108 is at least one ⅜ inch fiberglass rod. In some embodiments, the flexible member 108 is constructed of carbon fiber or metal, such as spring steel.

The fastener 110 is configured to attach the flexible member 108 to the main body 106. In some embodiments, the fastener 110 may be a plurality of fasteners such as bolts and plates. In other embodiments, the fastener 110 can be an adhesive such as an epoxy or other similar material.

Figure 2:
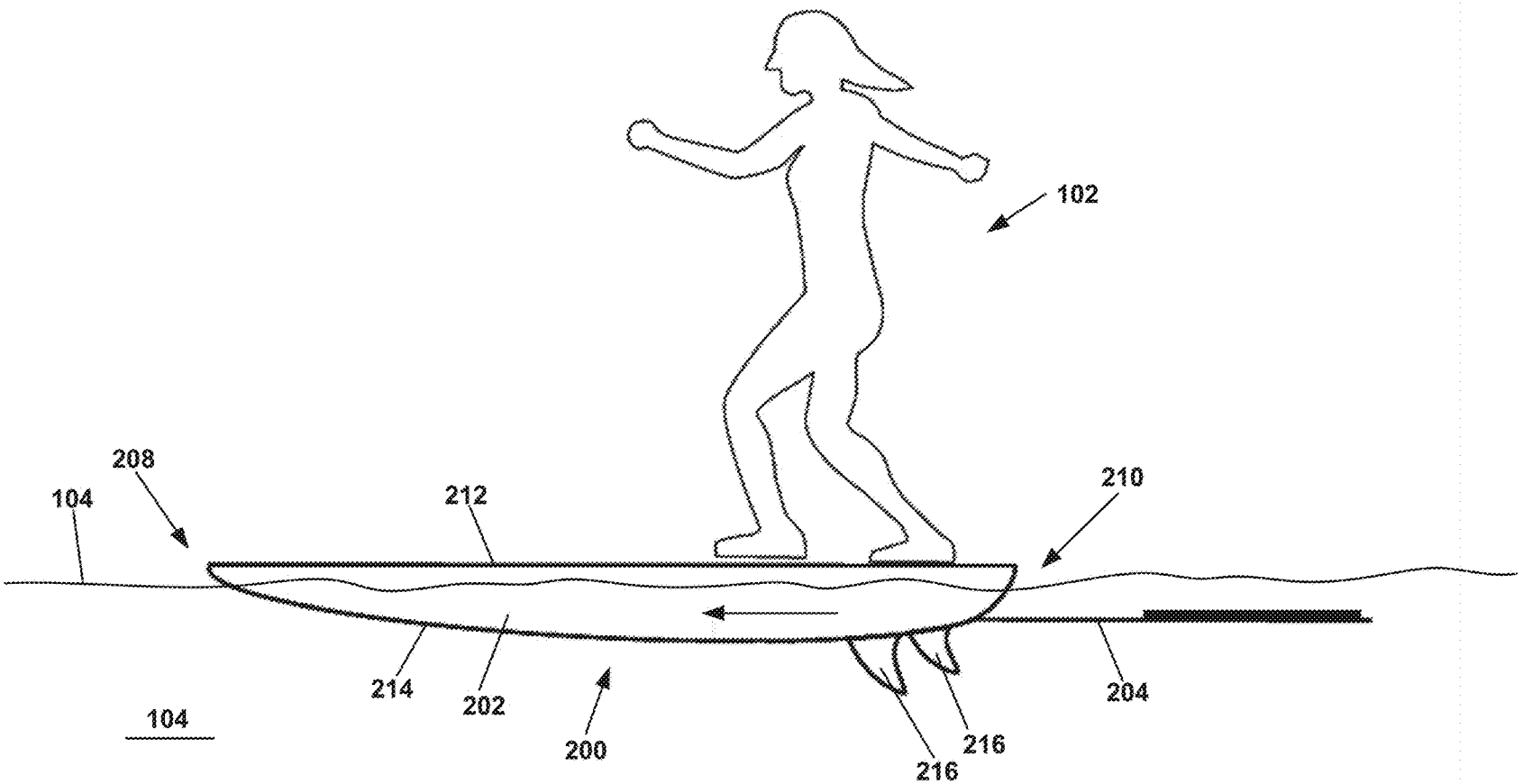
FIG. 2 illustrates a side view of a propellable aquatic board, according to one embodiment of the present disclosure.

FIGS. 2-8 show a propellable aquatic board 200, according to one embodiment of the present disclosure. Similar to FIG. 1, FIG. 2 shows a side view of the board 200 in the water 104 with the rider 102 riding the board 200. The board 200 includes a main body 202, a plurality of flexible members 204, and a plurality of fasteners 206 (shown in FIGS. 5-7). Further, the board 200 includes a front 208, a back 210, a top 212, and a bottom 214. Throughout this disclosure, references to orientation (e.g., front(ward), rear (ward), in front, behind, above, below, high, low, back, top, bottom, under, underside, etc.) of structural components shall be defined by that component's positioning in FIG. 2 relative to, as applicable to the front 208, back 210, top 212, and bottom 214 of the board 200, regardless of how the board 200 may be positioned in or out of the water 104.

The main body 202 is substantially similar to the main body 106, described above. The main body 202 is at least partially buoyant. The top 212 is at least partially flat so as to allow a rider to stand atop to board 200. The bottom 214 is configured to be submerged in water 104 and has a generally rounded shape. In the depicted embodiments, a plurality of detachable fins 216 are secured to the bottom 214 of the board 100 at the rear 210.

At the rear 210 of the main body 202, the plurality of flexible members 204 is attached to the main body 202. The plurality of flexible members 204 is substantially similar to the flexible member 108 described above. The flexible members 204 are configured to be submerged under water 104 when the board 200 is being ridden by the rider 102. The flexible members extend from the main body 202 to form a tail 222

Figure 3:
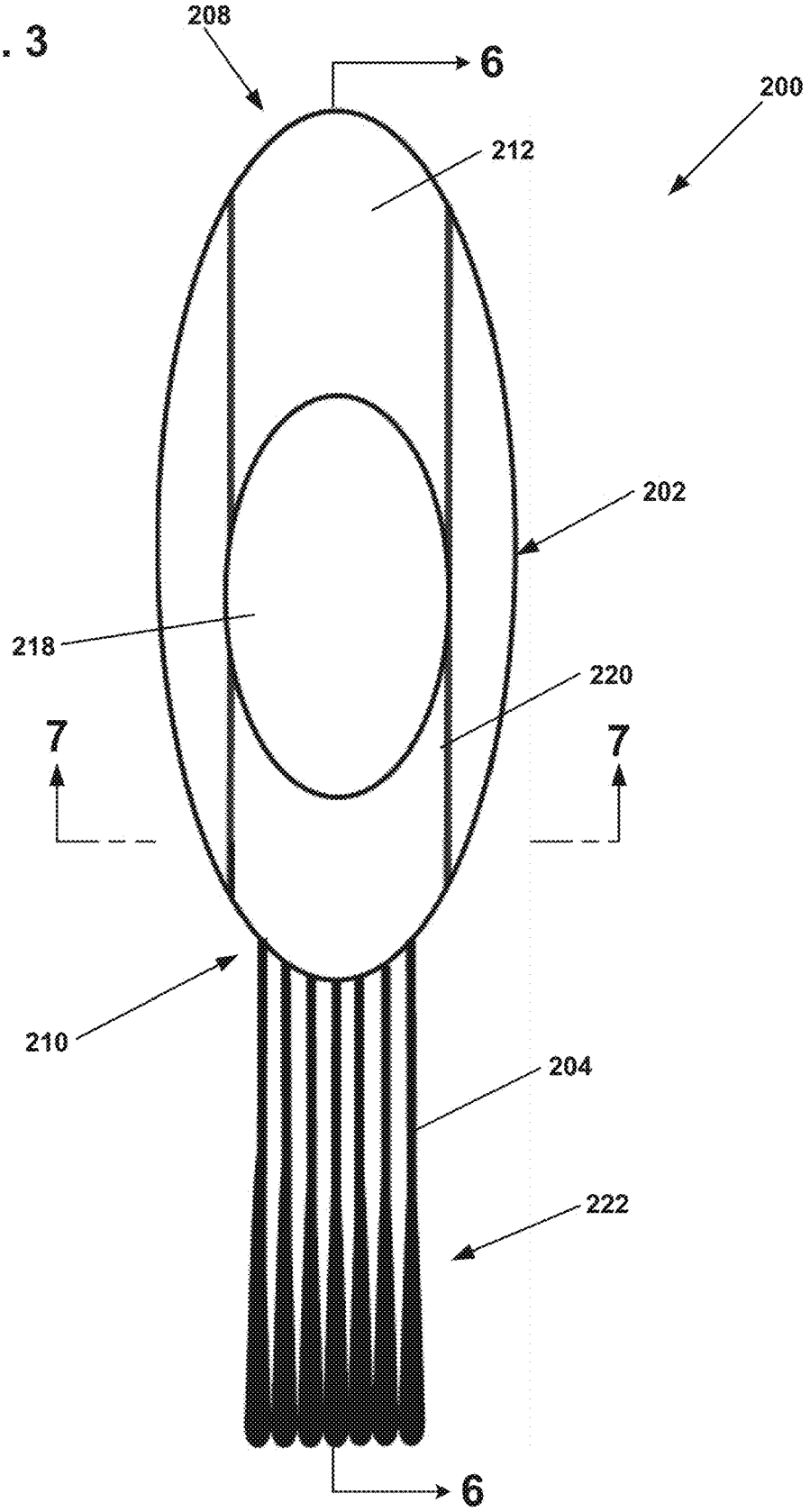
FIG. 3 illustrates a top view of the propellable aquatic board of FIG. 2.

FIG. 3 shows a top view of the board 200. The top 212 of the board 200 can include a grip pad 218 configured to aid the rider 102 in maintaining control of the board 200. In some embodiments, the grip pad 218 is manufactured from rubber, foam, or other traction improving material. In some embodiments, the top 212 is coated with a grip-like coating. In other embodiments still, the top 212 is textured to provide traction to the rider 102.

In the depicted embodiments, the board 200 includes a pair of longitudinally running reinforcement struts 220. The struts 220 are configured to give the board 200 increased rigidity. In some embodiments, the struts 220 are embedded in the main body 202 and travel from the front 208 to the rear 210 of the board 200. In some embodiments, the struts 220 are manufactured from a material that is different than the material used to manufacture the main body 202. In some embodiments, the struts are manufactured from plywood, aluminum, laminated wood material, or similar material.

As shown, the board 200 includes the plurality of flexible members 204 that extend away from the rear 212 in a direction opposite the front 208 of the board 200. The flexible members 204 are configured to each individually flex so as to allow the rider 102 to control the movement of the board 200. Together, the plurality of flexible members 204 form the tail 222.

Figure 4:
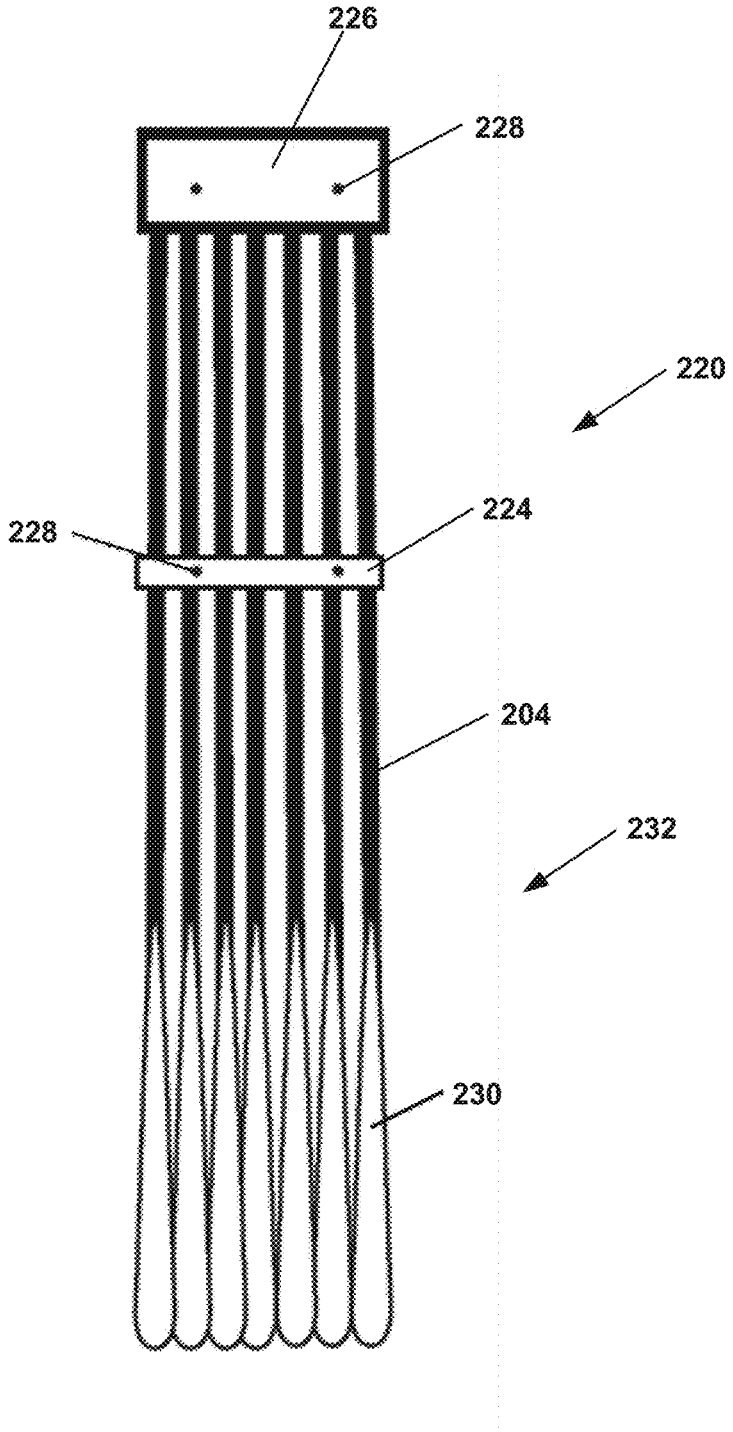
FIG. 4 illustrates a top view of a tail portion of the propellable aquatic board of FIG. 2.

FIG. 4 shows the flexible members 204 forming the tail 222, which is attachable to the main body 202. The tail 222 includes a brace 224 and a block 226. Both brace 224 and block 226 include mounting features 228 to allow the tail to be mounted to the main body 202. The brace 224 and block 226 are manufactured from materials similar to those that are used to manufacture the struts 220, such as aluminum, carbon fiber, wood, etc.

The flexible members 204 are secured to the main body 202 by way of the brace 224 and block 226. However, individual flexible members 204 can be removed and replaced in the tail 222 as necessary. The flexible members 204 can have a variety of different shapes. In the depicted embodiment, the flexible members 204 are rods that include a fanned out portion 230 at a rear 232 of the flexible member 204. The fanned out portion 230 is configured to give the flexible member 204 a wider surface area in the water 104, improving the thrusting abilities when the flexible members 204 are submerged and deflected by the rider 102.

Figure 5:
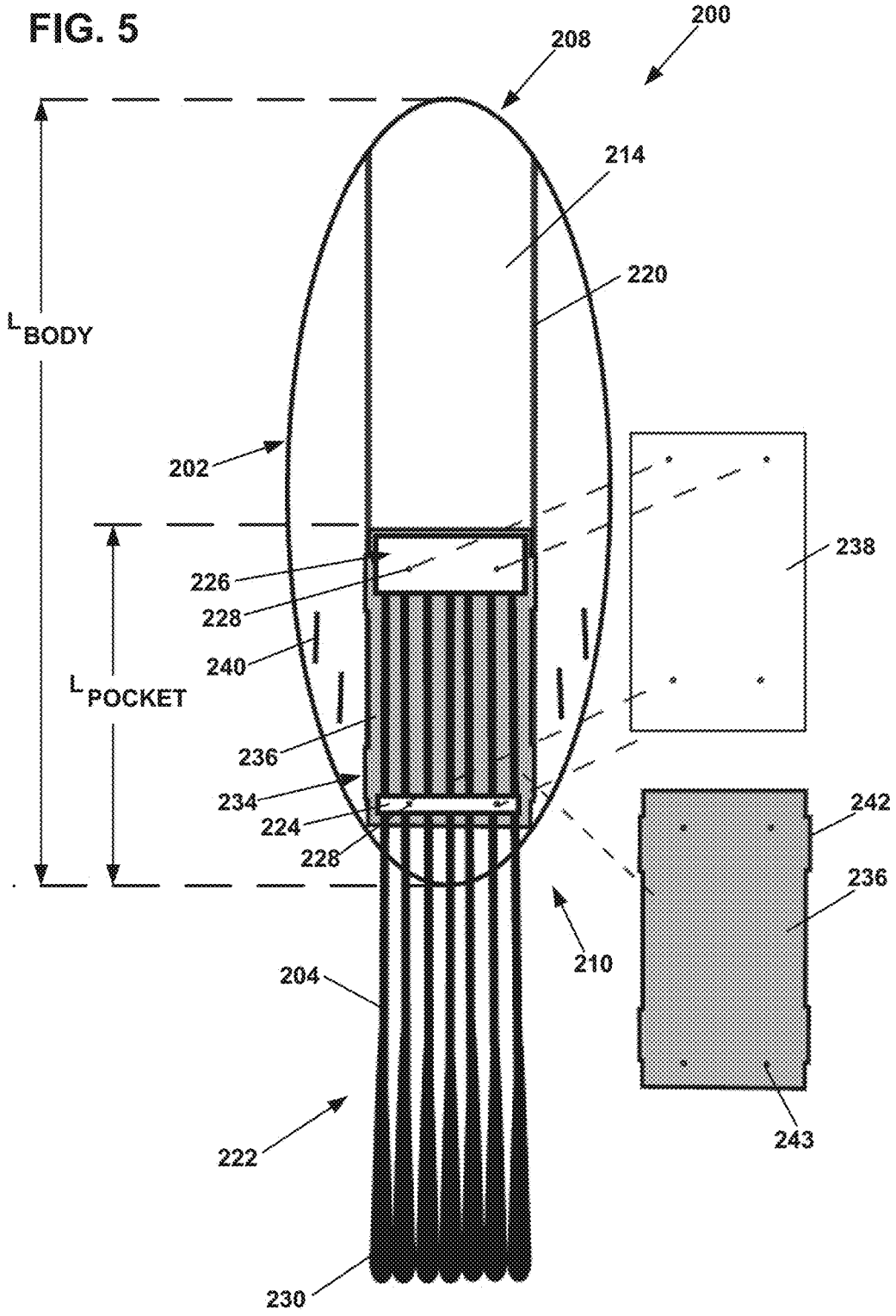
FIG. 5 illustrates a bottom view of the propellable aquatic board of FIG. 2.

FIG. 5 shows a bottom view of the board 200. The tail 222 is positioned within a pocket 234 of the main body 202. Specifically, the tail 222 is secured to the main body 202 by way of a mounting plate 236. Further, in some embodiments, a tail cover 238 is then placed over a portion of the tail 222 that is secured to the main body 202. Further, the bottom 214 of the board 200 includes a plurality of fin mounting locations 240 for mounting fins 216 (shown in FIG. 2).

Figure 6:
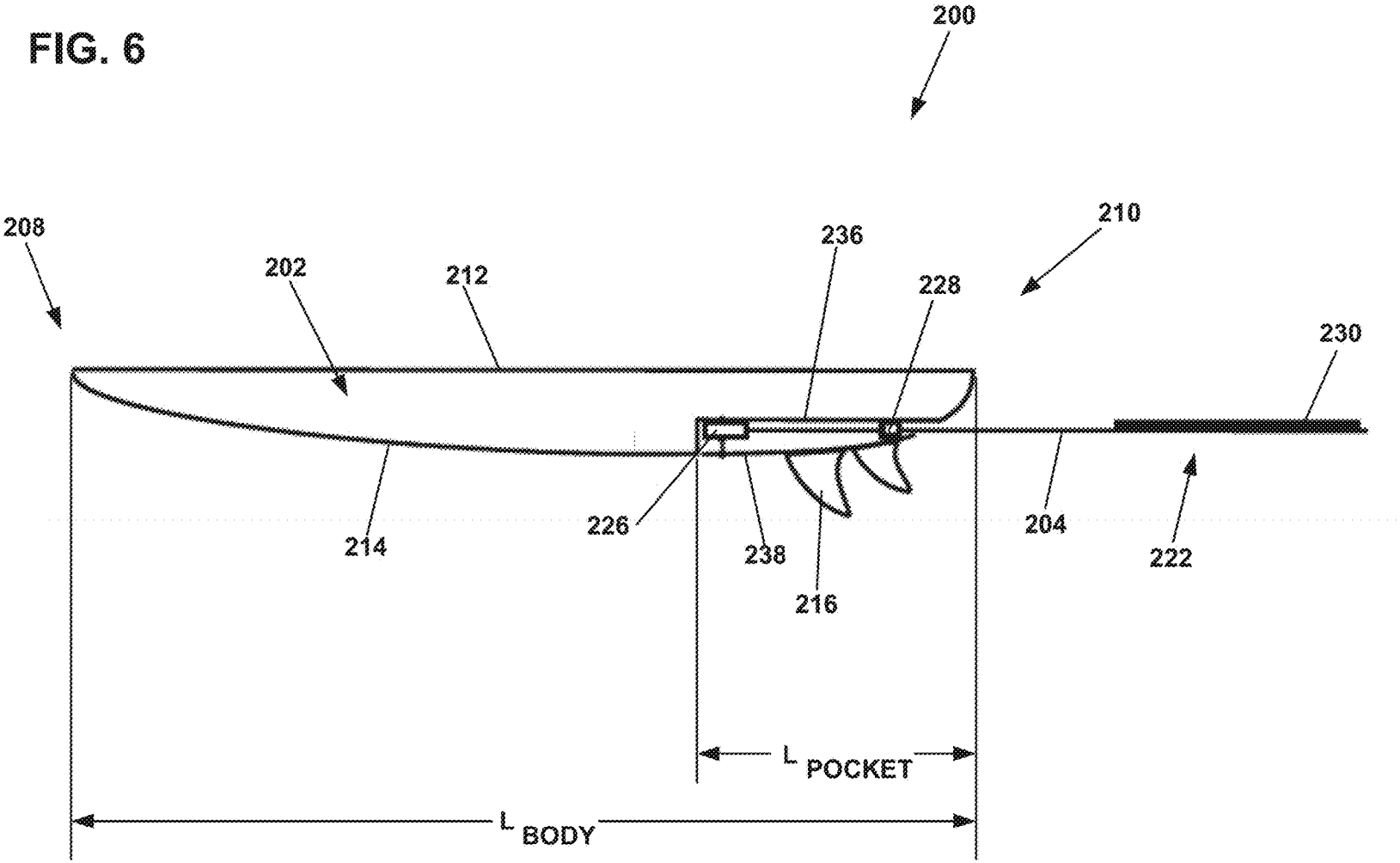
FIG. 6 illustrates a cross-sectional view of the propellable aquatic board of FIG. 2 along line 6-6.
Figure 7:
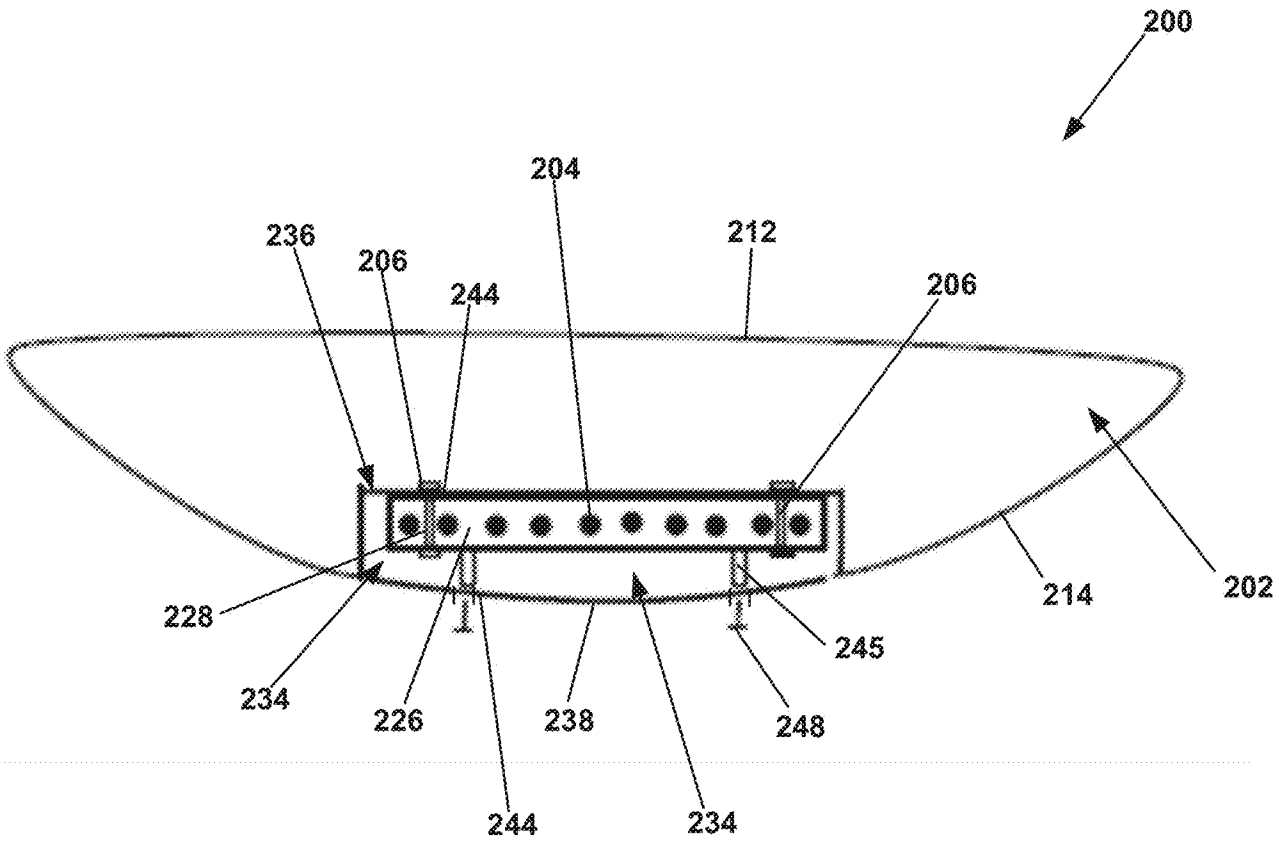
FIG. 7 illustrates a cross-sectional view of the propellable aquatic board of FIG. 2 along line 7-7.

The pocket 234 is positioned at the rear 210 of the board 200 and is recessed into the main body 202 from the bottom 214 (shown in FIGS. 6-7). The pocket 234 is positioned between the struts 220 and sized to accommodate a substantial length of the tail 222 so as to properly support the tail 222. In some embodiments, the pocket 234 has a length $L_{pocket}$ that is greater than about one quarter of a length $L_{body}$ of the main body 202. In some embodiments, the pocket 234 has a length $L_{pocket}$ that is greater than about one third of a length $L_{body}$ of the main body 202. In still other embodiments, the length of the pocket $L_{pocket}$ is at least half the length $L_{body}$ of the main body 202.

The mounting plate 236 is configured to aid in mounting the tail 222 to the main body 202 of the board 200. The mounting plate 236 is configured to be mounted within the pocket 234, before the tail 222 is mounted within the pocket 234. As shown, the mounting plate 236 includes strut interfacing features 242 that are configured to interface with the struts 220 so as to aid in securing the mounting plate 236 to the board 200. Specifically, in the depicted embodiment, the strut interfacing features 242 are a plurality of flanges that are configured to mate with struts 220.

Further, the mounting plate includes a plurality of mounting features 243 in the form of holes that are configured to receive the fastener 206, such as a bolt, to aid in securing the mounting plate 236 to the board 200. In some embodiments, the mounting plate 236 is manufactured from a lightweight, strong material such as aluminum, carbon fiber, or other similar material.

The cover 238 is configured to at least partially cover the pocket 234 and to provide a generally uniform bottom surface 214. In some embodiments, the cover 238 can have a rounded shape so as to match the shape of the bottom 214 of the board 200 (as shown in FIG. 6). Like the block 226, brace 224, and mounting plate 236, the cover 238 includes a plurality of mounting features 244 so as to allow the cover 238 to be secured to the main body 202. In some embodiments, the cover 238 is constructed of a water resistant material such as plastic, a laminated wood product, or similar material.

To install the tail 222 on the main body 202, the mounting plate 236 is first installed and secured in the pocket 234. Specifically, the strut interfacing features 242 of the mounting plate 236 are secured to the struts 220. The brace 224 and block 226 of the tail 222 are then positioned within the pocket 234, along with the flexible members 204. The mounting features 228 of the brace 224 and block 226 are aligned and secured with the mounting features 243 of the mounting plate 236. In the depicted embodiment, mounting features 228 are mated and secured with the mounting features 243 by way of fasteners 206, such as a plurality of bolts. The cover 238 is then placed over the brace 224, block 226, and mounting plate 236, and the cover mounting features 244 are aligned with either the mounting features 228, 243 of the brace 224, block 226, and mounting plate 236 or additional separate mounting features, such as spacers 245 (shown in FIG. 7) that are secured to the block 226 and brace 224. In the depicted embodiment, the mounting features 228, 243, 244 of the brace 224, block 226, mounting plate 236, and cover 238 are secured to the main body 202 of the board 200 by way of fasteners 206, such as a plurality of bolts. Once the tail 222 is secured in place to the main body 202, the board 200 is ready to be operated by the rider 102 in the water 104.

The fin mounting locations 240 are positioned proximate to the rear 210 of the board 200 and adjacent the pocket 234. The fin mounting locations 240 are configured to provide an interface for the mounting of fins 216 (as shown in FIG. 2). The fin mounting locations 240 are staggered in a pair at either side of the pocket 234, allowing the rider 102 to add or remove fins 216 to their preference. In some embodiments the fins 216 are constructed of the same material as the main body 202 of the board 200 and removably secured to the main body 202.

FIG. 6 shows a longitudinal cross-section of the board 200 along line 6-6 in FIG. 3. The pocket 234 is recessed into the bottom 214 of the main body 202 of the board 200 so as to secure the tail 222 to the main body 202. The tail 222 protrudes in a longitudinal direction away from the rear 210 in a direction away from the front 208. The tail 222 is positioned below the top 212 and above the lowest point of the bottom 214 of the board 200. This allows the tail 222 to be submerged when the board 200 is in the water 104.

FIG. 7 shows a transverse cross-section of the board 200 along line 7-7 in FIG. 3. As shown, the flexible members 204 of the tail 222 are positioned with the block 226. The block 226 is then secured to the mounting plate 236 by way of a plurality of fasteners 206, or other similar fastener. Also shown are the spacers 245 secured to the block 226. The spacers 245 are configured to receive a pair of cover fasteners 248 that are configured to secure the cover 238 to the main body 202.

Figure 8:
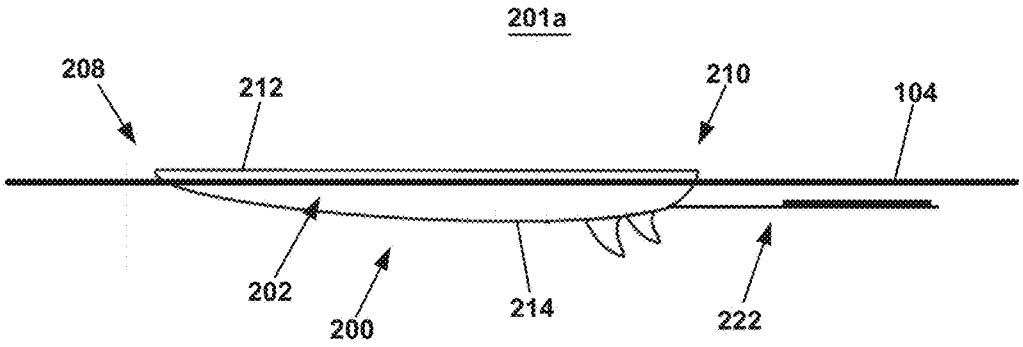
FIG. 8 illustrates a schematic side view of the propellable aquatic board of FIG. 2 in a first position.
Figure 9:
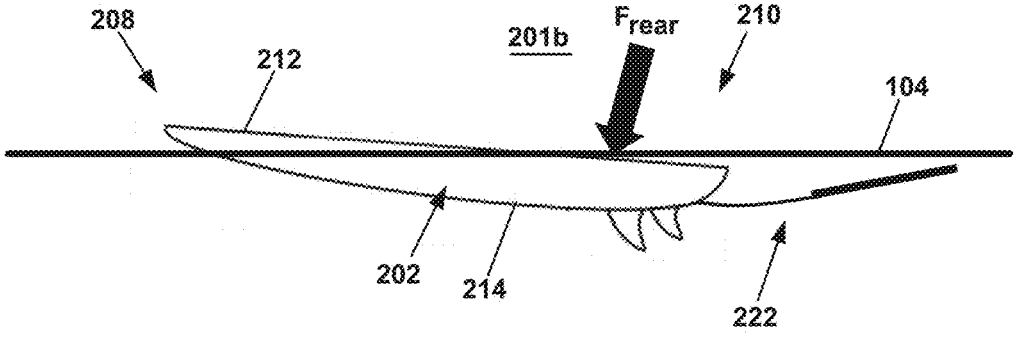
FIG. 9 illustrates a schematic side view of the propellable aquatic board of FIG. 2 in a second position.
Figure 10:
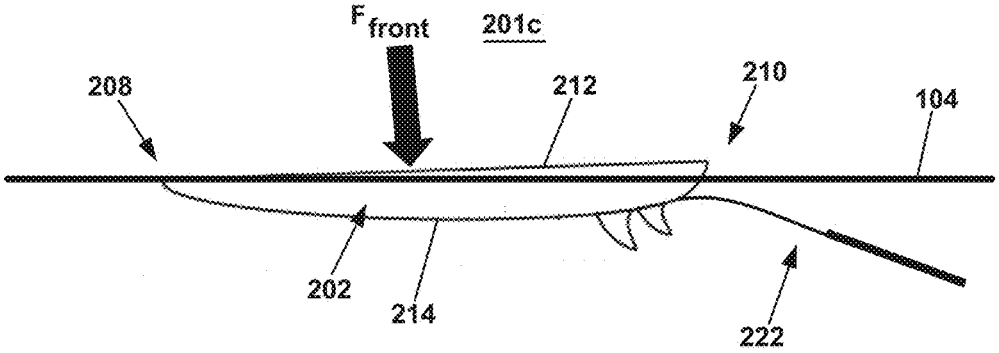
FIG. 10 illustrates a schematic side view of the propellable aquatic board of FIG. 2 in a third position.

FIGS. 8-10 show a motion view of the board 200 when the rider 102 is propelling the board 200 through the water 104. Specifically, the board 200 is shown in a first position 201*a*, a second position 201*b*, and a third position 201*c*.

As shown in FIG. 8, in the first position 201*a*, the board 200 is not being propelled through the water 104 and is floating generally level with the surface of the water 104.

When preparing to propel the board 200 through the water 104, the rider 102 positions his/her feet in a staggered position generally on the back half of the board 200.

As shown in FIG. 9, when the rider 102 would like to propel the board 200 through the water 104, the rider 102 exerts a force $F_{rear}$ near the rear 210 of the board 200 with their rear-most foot to move the board 200 into the second position 201*b*. The force $F_{rear}$ causes the front 208 of the board 200 to rise from the surface of the water 104 and the rear 210 of the board 200 to become more submerged in the water 104. Further, the force $F_{rear}$ also causes the tail 222, and the flexible members 204 within, to temporally deflect. The deflection is caused by resistance of the water exerting a force on the flexible members 204 of the tail 222. As the tail 222 deflects, the flexible members 204 store kinetic spring energy as they attempt to return to their non-deflected state.

As shown in FIG. 10, to take advantage of the kinetic spring energy temporally stored in the tail 222, the rider 102 exerts a force $F_{front}$ with their forward-most foot at a location on the top 212 of the board 200 nearer the front 208 than the location at which the force $F_{rear}$ was exerted. This causes the board 200 to move from the second position 201*b* to the third position 201*c*. Such an exertion also creates a rhythmic-like weight changing motion between the two feet of the rider 102. As the force $F_{front}$ is exerted, the front 208 of the board 200 moves in a direction toward the surface of the water 104 and the rear 210 of the board 200 moves away from the surface of the water 104. Simultaneously, the tail 222 deflects in the opposite direction from its deflection position of the first position 201*a*. As the tail 222 changes position, the kinetic energy stored in the tail, specifically the flexible members 204, is released and transformed into thrust, which propels the board 200 in a forward direction (shown by an arrow) through the water 104. Such a motion is similar to a swimming motion.

To continue propelling the board 200, the rider continues to alternate applying the force $F_{front}$ and the force $F_{rear}$. By continuing to alternate the force applied to the board 200, the rider 102 can achieve exercise-type motion. Additionally, the rider 102 may walk or even jog during this alternating force/weight transfer.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

I claim:

1. A propellable aquatic board comprising:

a main body being at least partially buoyant, the main body including a bottom surface configured to be at least partially submerged in a body of water; and a plurality of flexible rods secured to the main body by a fastener at a first location and secured to the main body by a brace at a second location, which is spaced away from the first location, wherein the plurality of flexible rods extends away from the main body in a longitudinal direction, and wherein the plurality of flexible rods is configured to selectively deflect in unison between an upward vertical direction and a downward vertical direction upon the aquatic board receiving a force from a user to propel the aquatic board through water.

2. The propellable aquatic board of claim 1, further comprising at least one strut positioned longitudinally within the main body.

3. The propellable aquatic board of claim 1, further comprising a pair of struts positioned longitudinally within the main body.

4. The propellable aquatic board of claim 1, wherein the fastener includes a mounting plate secured to the main body and a plurality of fasteners configured to secure the plurality of flexible rods to the mounting plate.

5. The propellable aquatic board of claim 1, further comprising at least one fin extending from at least one of the plurality of flexible rods.

6. The propellable aquatic board of claim 1, wherein the plurality of flexible rods define a tail, the propellable aquatic board further comprising a removable tail cover positioned over a portion of the tail.

7. The propellable aquatic board of claim 1, wherein the plurality of flexible rods includes a front portion and a rear portion, wherein the front portion is secured to the main body, and wherein the rear portion includes a fanned out portion configured to increase the surface area of the flexible member.

8. A propellable aquatic board comprising:

a main body being at least partially buoyant, the main body having a top surface, a bottom surface, a front portion, and a rear portion, wherein the bottom surface is configured to be at least partially submerged in a body of water;

a plurality of flexible members being secured to the main body by a fastener, wherein the flexible members extend in a longitudinal direction opposite the front portion of the main body; and a brace member connecting the flexible members to one another, wherein the brace member is secured to the main body at a location spaced away from the fastener, wherein the plurality of flexible members are flexible in an upward vertical direction and in a downward vertical direction to propel the aquatic board through water.

9. The propellable aquatic board of claim 8, further comprising at least one strut positioned longitudinally within the main body.

10. The propellable aquatic board of claim 8, further comprising a pair of struts positioned longitudinally within the main body.

11. The propellable aquatic board of claim 8, wherein the fastener includes a mounting plate secured to the main body.

12. The propellable aquatic board of claim 8, wherein the plurality of flexible members each include a front portion and a rear portion, wherein the front portion is secured to the main body, and wherein the rear portion includes a fanned out portion configured to increase the surface area of the flexible member.

13. A propellable aquatic board comprising:

a main body being at least partially buoyant, the main body including a bottom surface configured to be at least partially submerged in a body of water;

a plurality of flexible members each having a front end and a rear end, wherein the front end of each flexible member is connected to the main body by a fastener; and a brace member connecting the plurality of flexible members to one another at a position between the front and rear ends of each flexible member, wherein the plurality of flexible members are flexible in an upward vertical direction and in a downward vertical direction to propel the aquatic board through water.

* * * * *